US006580400B2

(12) United States Patent
Sato et al.

(10) Patent No.: US 6,580,400 B2
(45) Date of Patent: Jun. 17, 2003

(54) PRIMARY RADIATOR HAVING IMPROVED RECEIVING EFFICIENCY BY REDUCING SIDE LOBES

(75) Inventors: Keiichiro Sato, Fukushima-ken (JP); Toshiaki Konno, Fukushima-ken (JP); Dou Yuanzhu, Fukushima-ken (JP); Shuji Saito, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/821,372

(22) Filed: Mar. 29, 2001

(65) Prior Publication Data

US 2001/0026242 A1 Oct. 4, 2001

(30) Foreign Application Priority Data

Mar. 31, 2000 (JP) ..... 2000-099254
Mar. 31, 2000 (JP) ..... 2000-099261

(51) Int. Cl.[7] ..... H01Q 13/00
(52) U.S. Cl. ..... 343/785; 343/772
(58) Field of Search ..... 343/785, 772, 343/786; H01Q 13/00

(56) References Cited

U.S. PATENT DOCUMENTS

| | | | | |
|---|---|---|---|---|
| 3,434,146 A | * | 3/1969 | Petrich | 343/753 |
| 4,447,811 A | | 5/1984 | Hamid | |
| 4,658,258 A | * | 4/1987 | Wilson | 343/786 |
| 5,552,797 A | * | 9/1996 | Cook | 343/786 |
| 5,652,599 A | | 7/1997 | Pitta et al. | |
| 5,841,404 A | * | 11/1998 | Yen | 343/786 |
| 6,137,449 A | | 10/2000 | Kildal | |
| 6,211,842 B1 | | 4/2001 | Cousin et al. | |
| 6,353,417 B1 | * | 3/2002 | Yuanzhu | 343/785 |

FOREIGN PATENT DOCUMENTS

| | | |
|---|---|---|
| GB | 2 314 688 | 1/1998 |
| JP | 10-163737 | 6/1998 |
| JP | 10-256822 | 9/1998 |
| WO | WO 99/57804 | 11/1999 |

OTHER PUBLICATIONS

United States Statutory Invention Registration No. H584, Published Feb. 7, 1989, Schwering et al.

IEE Proc.—Microw, "Improvements of dipole, helix, spiral, microstrip patch and aperture antennas with ground planes by using corrugated soft surfaces." , Jun. 1996, pp. 244–248, vol. 143, No. 3.

* cited by examiner

*Primary Examiner*—Hoanganh Le
(74) *Attorney, Agent, or Firm*—Brinks Hofer Gilson & Lione

(57) ABSTRACT

A radiation section of a dielectric feeder protrudes from an opening of a waveguide to improve the efficiency of receiving radio signals. An opening is provided at one end of the waveguide. A dielectric feeder held within the waveguide has a radiation section protruding from the opening. An annular wall having a bottom surrounds the opening of the waveguide. The depth of the annular wall is about ¼ of the wavelength of radio waves, and the width of a bottom surface of the annular wall is about ⅙ to 1/10 of the wavelength of the radio waves. Consequently, the phases of a surface current that flows from the opening toward the bottom surface of the annular wall and a surface current which flows from the bottom surface of the annular wall toward the open end are substantially out of phase. As a result, the side lobes of the received radio signals are greatly reduced, and the gain of the main lobe is increased, improving the reception of radio waves transmitted from a satellite.

12 Claims, 7 Drawing Sheets

PRIMARY RADIATOR HAVING IMPROVED RECEIVING EFFICIENCY BY REDUCING SIDE LOBES

BACKGROUND OF THE INVENTION

1. Field of the Invention

The present invention relates to a primary radiator used in a satellite antenna, etc., and, more particularly, to a primary radiator using a dielectric feeder.

2. Description of the Related Art

FIG. 16 is a sectional view of a conventional primary radiator using a dielectric feeder. The primary radiator comprises a waveguide 10 that has an open end and a closed end. The closed end is bounded by a surface 10*a*. A dielectric feeder 11 is held in an opening 10*b* of the waveguide 10. Inside the waveguide 10, a first probe 12 and a second probe 13 are positioned orthogonal to each other, and the distance between these probes 12 and 13 and the surface 10*a* is approximately ¼ of the guide wavelength.

The dielectric feeder 11 is made of a dielectric material, such as polyethylene. A radiation section 11*b* and an impedance conversion section 11*c* are formed at ends of the dielectric feeder 11 which has a holding section 11*a* as a boundary formed therebetween. The outer diameter of the holding section 11*a* is nearly the same as the inner diameter of the waveguide 10, and the dielectric feeder 11 is fixed to the waveguide 10 by the holding section 11*a*. Both the radiation section 11*b* and the impedance conversion section 11*c* have a conical shape. The radiation section 11*b* protrudes outward from the opening 10*b* of the waveguide 10, and the impedance conversion section 11*c* extends to an interior of the waveguide 10.

The primary radiator described above is disposed at a focal position of a reflecting mirror of a satellite reflection-type antenna. In this device, radio waves transmitted from a satellite are focused to the inside of the dielectric feeder 11 from the radiation section 11*b*. Impedance matching is performed by the impedance conversion section 11*c* of the dielectric feeder 11. The radio waves travel into the interior of the waveguide 10. When the radio waves are received by the first probe 12 and the second probe 13, the received signal is frequency-converted into an IF frequency signal by a converter circuit (not shown).

As illustrated by the dashed line in FIG. 15, the radiation pattern received by the primary radiator described above contains side lobes. The side lobes are formed because a surface current flows to the outer surface of the waveguide 10 and is radiated due to the discontinuity of the impedance that lies within the opening 10*b*. For example, when the designed radiation angle of the radiation section 11*b* is 90 degrees (i.e., ±45 degrees with respect to the center), high amplitude side lobes are generated in the range of ±50 degrees. Because the gain of the main lobe in the central portion of the radiation angle is decreased, the radio waves from the satellite are not received efficiently.

SUMMARY OF THE INVENTION

According to a first aspect, a primary radiator comprises a waveguide having an opening at one end that receives a dielectric feeder. The dielectric feeder is held within the waveguide. A radiation section is formed such that a portion protrudes from the opening of the waveguide. An annular wall having a bottom wall and an opening, is provided adjacent to the waveguide. The depth of the annular wall is about ¼ of the wavelength of the radio waves. Preferably, the width of a bottom surface of the annular wall is about ⅙ to 1/10 of the wavelength of the radio waves.

According to a second aspect, the phases of a surface current flowing on the outer surface of the opening of the waveguide and a surface current flowing on the inner surface of the annular wall are about one hundred and eighty degrees out of phase. Accordingly, the currents substantially cancell, the amplitude of the side lobes are greatly reduced, and the gain of the main lobe is increased. Furthermore, if a plurality of annular walls are provided concentrically, the amplitude of the side lobes are also reduced.

According to a third aspect, a primary radiator comprises a waveguide having an opening at one end that receives a dielectric feeder that is held within the waveguide. A radiation section is formed such that a portion protrudes from the opening of the waveguide. A gap having a depth of about ¼ of the wavelength of the radio waves is provided between an inner wall surface of the opening of the waveguide and the outer surface of the dielectric feeder.

In this aspect, the phases of a surface current flowing on the outer surface of the dielectric feeder and a surface current flowing on the inner surface of the waveguide are substantially out of phase and cancel or substantially cancel each other. As a result, the side lobes are greatly reduced, and the gain of the main lobe is increased.

In a fourth aspect, the gap can be formed by making the opening of the waveguide protrude outward. The gap is formed within recessed sections in which the outer surface of the dielectric feeder is cut out. In this aspect, preferably, the width (i.e., the facing distance between the dielectric feeder and the waveguide) of the gap is about ⅙ to 1/10 of the diameter of the opening of the waveguide.

Although the gap can be provided around the entire periphery of the inner wall surface of the opening of the waveguide in the above described aspects, the gap also may be provided in a portion of the inner wall surface of the opening of the waveguide when a symmetry is substantially maintained. In this aspect, preferably, a plurality of recessed sections are formed on the outer surface of the dielectric feeder, and the projection portions between recessed sections are coupled to the inner wall surface of the opening of the waveguide. In this arrangement, the holding strength of the dielectric feeder increases.

DESCRIPTION OF THE PREFERRED EMBODIMENTS

Figure 1:
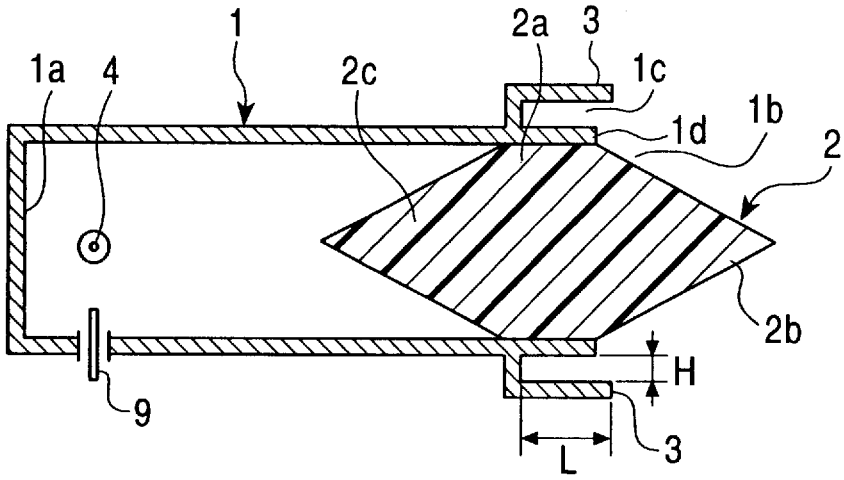
FIG. 1 is a sectional view of a primary radiator according to a first embodiment.
Figure 2:
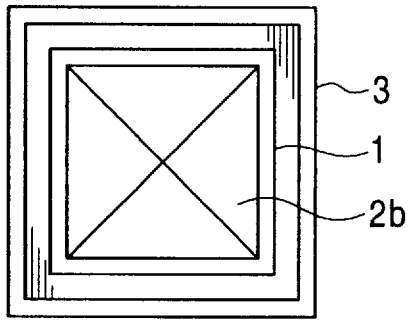
FIG. 2 is a right side view of FIG. 1.

As shown in FIGS. 1 and 2, a primary radiator according to a first embodiment comprises a waveguide 1 having a rectangular cross section. The waveguide 1 has an open end and a closed end. The closed end is bounded by a closed surface 1*a*. A dielectric feeder 2 is partially held within an opening 1*b* of the waveguide 1. An annular wall 3 is positioned adjacent to the opening 1*b*. Inside the waveguide 1, a first probe 4 and a second probe 9 are orthogonal to each other, and the distance between probes 4 and 9 and the closed surface 1*a* is about ¼ of the guide wavelength $\lambda_g$. The probes 4 and 9 are connected to a converter circuit (not shown).

In this embodiment, the waveguide 1 is a unitary part of the annular wall 3, integrally molded through an aluminum die casting, etc. In alternative embodiments, the annular wall 3 can be welded, glued, or mechanically coupled to the outer surface of the waveguide 1. Preferably, the annular wall 3 has a bottom wall, and an opening 1*c* that is adjacent to the waveguide opening 1*b*. In this arrangement, the inlets that access the openings 1*b* and 1*c* are positioned on a common side of waveguide 1. If the depth of the annular wall 3 is denoted as L, the dimension L is about ¼ of the wavelength $\lambda$ of the radio waves propagating within the annular waveguide 1. Furthermore, if the width, which is the space between the outer surface of the waveguide 1 and the inner surface of the annular wall 3 is denoted as H, the dimension H is about ⅙ to 1/10 of the wavelength $\lambda$ of the radio waves.

The dielectric feeder 2 is preferably made of a dielectric material, such as polyethylene, for example. A radiation section 2*b* is coupled to an impedance conversion section 2*c* through a holding section 2*a*. The holding section 2*a* has a prism shape that can be press fitted or bonded within the waveguide 1. In this embodiment, the radiation section 2*b* and the impedance conversion section 2*c* have pyramid shapes. The radiation section 2*b* protrudes outward from the opening 1*b* of the waveguide 1 and the impedance conversion section 2*c* extends to an interior of the waveguide 1.

Radio waves transmitted from a satellite are received by a reflecting mirror of an antenna (not shown). The reflecting mirror reflects the radio waves into the primary radiator. The radio waves travel through the radiation section 2*b* into the interior of the dielectric feeder 2, which focuses the radio waves. The impedance conversion section 2*c* matches the impedance of the interior of the waveguide 1 which ensures an efficient transfer of the radio waves to the interior of the waveguide 1. The radio waves then are coupled to the first probe 4 and the second probe 9 before the signals are frequency-converted into an IF frequency signal by a converter circuit (not shown).

Figure 15:
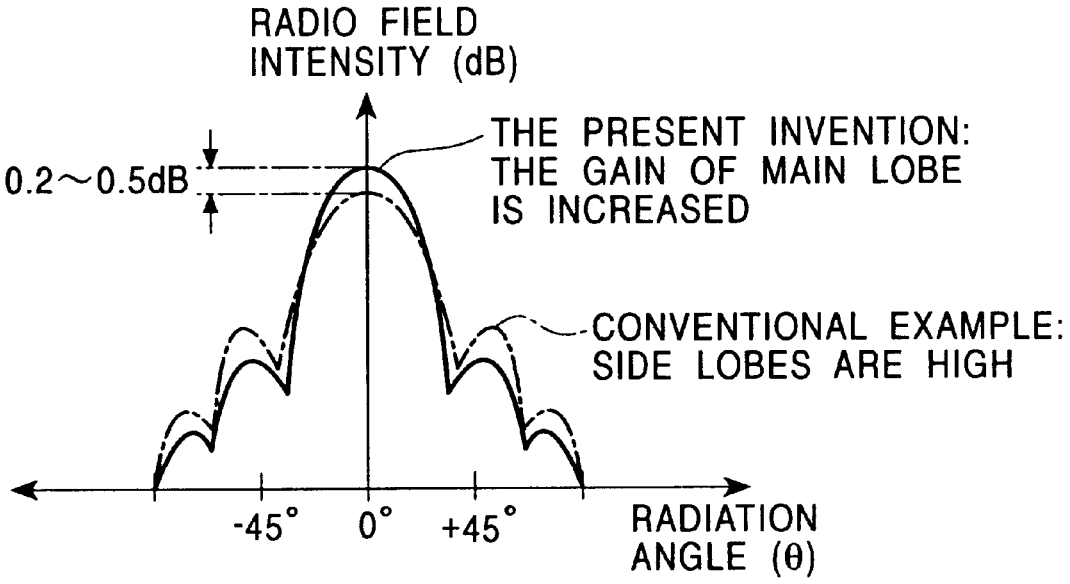
FIG. 15 is a comparison of radiation patterns of a conventional example to an embodiment.
Figure 16:
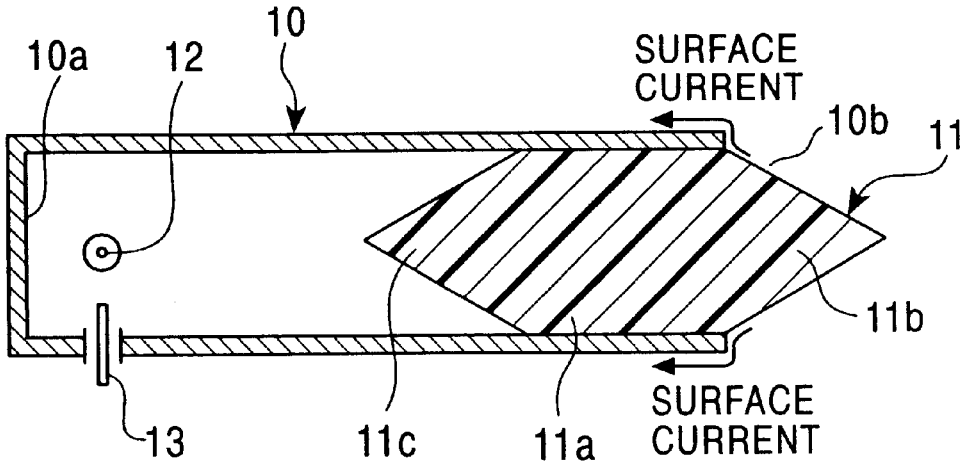
FIG. 16 PRIOR ART
FIG. 16 is a sectional view of a conventional primary radiator.

Since the annular wall 3, having a depth of about ¼ of the radio wave wavelength, surrounds the outer side of the opening 1*b* in this embodiment, the phases of a surface currents cancel. Surface current $i_o$ which flows on the outer surface 1*d* of the waveguide 1 toward the bottom surface of the annular wall 3 and surface current $i_1$ which flows on an inner surface of the annular wall 3 from the bottom surface toward the inlet end are substantially out of phase, and thus cancel. As a result, side lobes of radio field intensity are reduced when compared to the conventional example shown as a dashed line in FIG. 15. Consequently, in this embodiment, the gain of the main lobe is increased by about 0.2 to 0.5 dB, which improves the reception of satellite radio waves.

Figure 4:
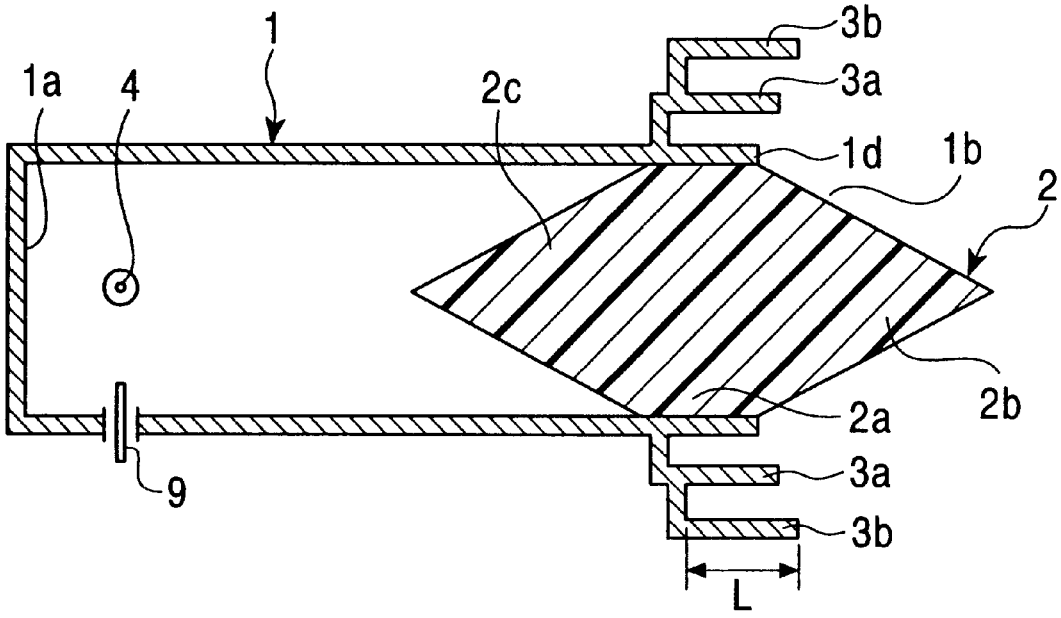
FIG. 4 is a sectional view of a primary radiator according to a second embodiment.
Figure 5:
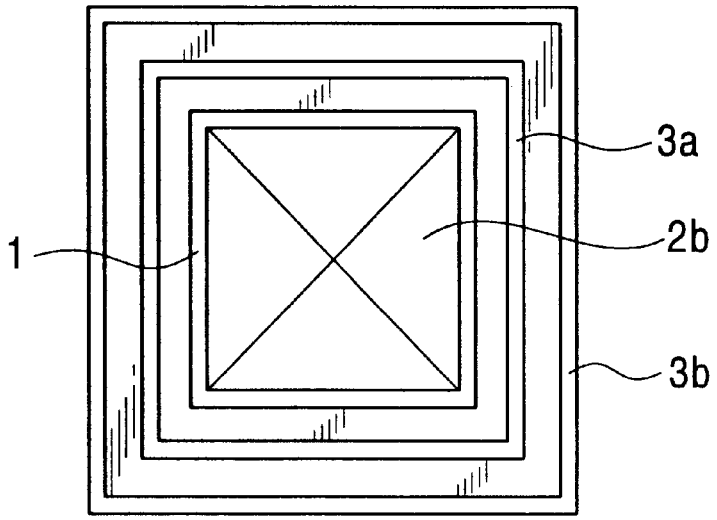
FIG. 5 is a right side view of FIG. 4.

In the second embodiment shown in FIGS. 4 and 5, two annular walls 3*a* and 3*b* are positioned concentrically outside the opening 1*b* of the waveguide 1. That is, the first annular wall 3*a* surrounds the opening 1*b* of the waveguide 1, and the second annular wall 3*b* surrounds the first annular wall 3*a*. In this embodiment, the dimension L which is the interior length of the annular walls 3*a* and 3*b* is about ¼ of the wavelength of the radio waves, and the dimension H is about ⅙ to 1/10 of the wavelength of the radio waves. Accordingly, if a portion of a surface current flows from outer surface 1*d* of the waveguide 1 to the second annular wall 3*b*, that surface current is cancelled by the current flowing from second annular wall 3*b*. This embodiment further reduces the side lobes depicted in FIG. 15.

Many other alternative are also possible. For example, the primary radiator may also receive a waveguide 1 having a circular cross section. In this embodiment, annular walls may be concentrically provided outside the circular opening of the waveguide 1. Furthermore, three or more annular walls may concentrically surround the circular opening.

Figure 6:
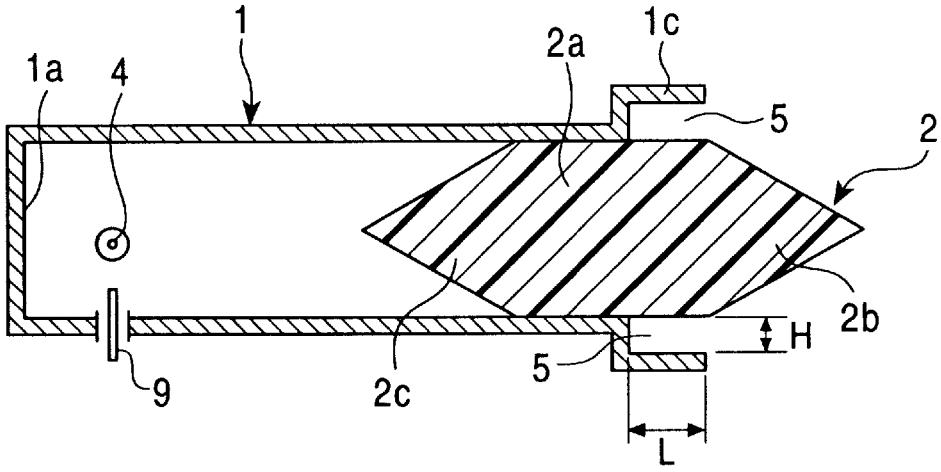
FIG. 6 is a sectional view of a primary radiator according to a third embodiment.
Figure 7:
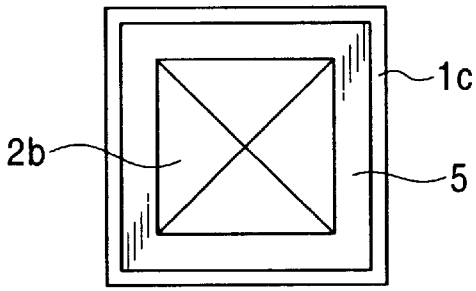
FIG. 7 is a right side view of FIG. 6.
Figure 8:
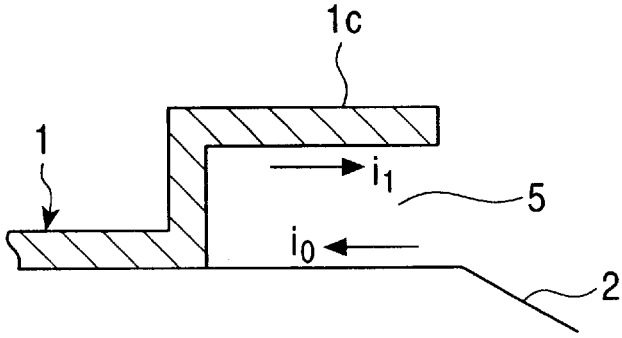
FIG. 8 is a main portion of FIG. 6.

As shown in FIGS. 6 and 7, the primary radiator according to a third embodiment comprises a waveguide 1 having a rectangular cross section. One end of the waveguide 1 terminates at an opening and the other end terminates at a closed surface 1*a*. A dielectric feeder 2 is held within the waveguide 1. The dielectric feeder 2 preferably includes an expanded section 1*c* positioned near the open end of the waveguide 1. The expanded section 1*c* preferably increases the opening portion of the waveguide 1 at an outer edge. Preferably, the cross-sectional size or diameter of the opening of the expanded section 1*c* is greater than the cross-sectional size or diameter of a main portion of the waveguide 1. Inside the waveguide 1, a first probe 4 is positioned orthogonal to a second probe 9 that passes through the interior and exterior surfaces of the waveguide 1 wall. Preferably, the distance between probes 4 and 9 and the closed surface 1*a* is about ¼ of the guide wavelength $\lambda_g$. In this embodiment, the probes 4 and 9 are connected to a converter circuit (not shown).

The dielectric feeder 2 is preferably made of a dielectric material, such as polyethylene for example. A radiation section 2*b* and an impedance conversion section 2*c* are formed at the ends of the dielectric feeder 2 with a holding section 2*a* formed near the center of the dielectric feeder 2 which acts as a boundary. In this embodiment, the holding section 2*a* has a prism shape and the outer dimension thereof is nearly the same dimension as an interior portion of the waveguide 1, which is separate from the expanded section 1*c*. The holding section 2*a* is fixed inside the waveguide 1 preferably by a press fitting, an adhesive, or a bonding.

An annular gap 5 is created between the expanded section 1*c* of the waveguide 1 and the outer surface of the dielectric feeder 2. If the depth of the gap 5 (the length of the interior surface of the expanded section 1*c* along an axial direction) is denoted as L, and the width of the gap 5 (the width of the interior bottom surface of the expanded section 1*c*) is denoted as H, the dimension L is preferably about ¼ of the wavelength $\lambda_\epsilon$ of the radio waves propagating through the dielectric feeder 2, and the dimension H is preferably about ⅙ to 1/10 of the opening diameter of the expanded section 1*c*. Both the radiation section 2*b* and the impedance conversion section 2*c* have a pyramid shape. In this embodiment, the radiation section 2*b* protrudes outward from the expanded section 1*c* of the waveguide 1, and the impedance conversion section 2*c* extends into the interior of the waveguide 1.

When radio waves are transmitted from a satellite, the radio waves are received by the reflecting mirror of an antenna (not shown). The reflecting mirror reflects the radio waves into the primary radiator. The radio waves travel through the radio section 2*b* into the interior of the dielectric feeder 2, which focuses the radio waves. An impedance matching is then performed by the impedance conversion section 2*c* before the radio waves travel into the interior of the waveguide 1. The radio waves then are coupled to the first probe 4 and the second probe 9 before the signals are frequency-converted into an IF frequency signal by a converter circuit (not shown).

Figure 3:
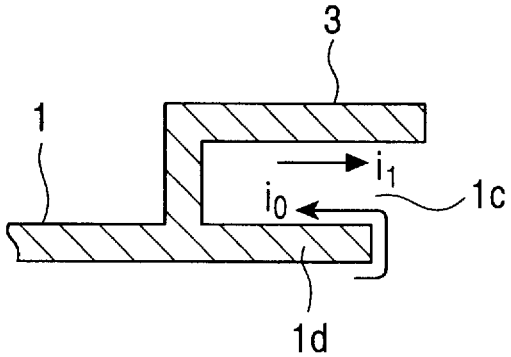
FIG. 3 is a main portion of FIG. 1.

Since the gap 5 having a depth of about $\lambda_\epsilon/4$ of the radio waves wavelength is created between the expanded section 1*c* of the waveguide 1 and the outer surface of the dielectric feeder 2, as shown in FIG. 3, the surface currents cancel. The phases of the surface current $i_o$ which flows on the outer surface of the dielectric feeder 2 toward the bottom surface and the surface current $i_1$, which flows on the inner surface of the opening 1*b* toward the open end are substantially 180 degrees or directly out of phase and thus, cancel each other. As a result, as shown by the solid line in FIG. 15, the side lobes are greatly reduced in comparison to the conventional example illustrated by the dashed line. Consequently, the gain of the main lobe is increased by about 0.2 to 0.5 dB in this embodiment, making it possible to efficiently receive radio waves from the satellite.

Figure 9:
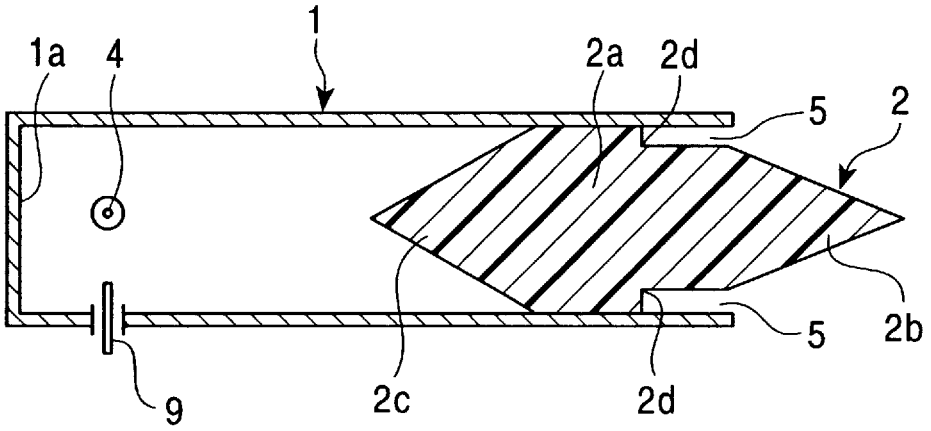
FIG. 9 is a sectional view of a primary radiator according to a fourth embodiment.
Figure 10:
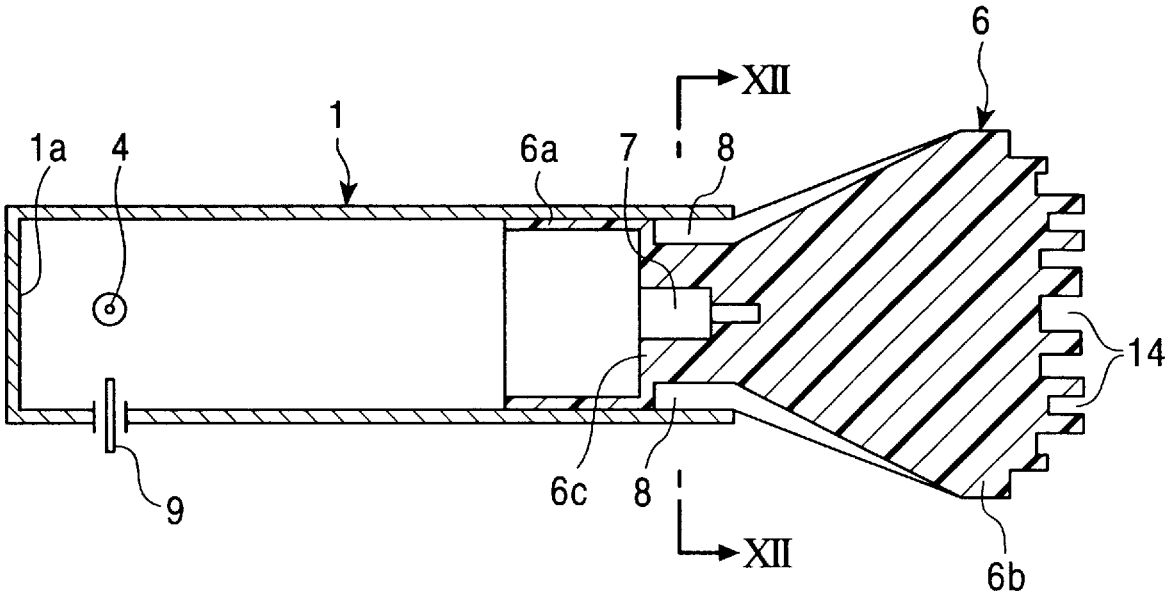
FIG. 10 is a sectional view of a primary radiator according to a fifth embodiment.
Figure 11:
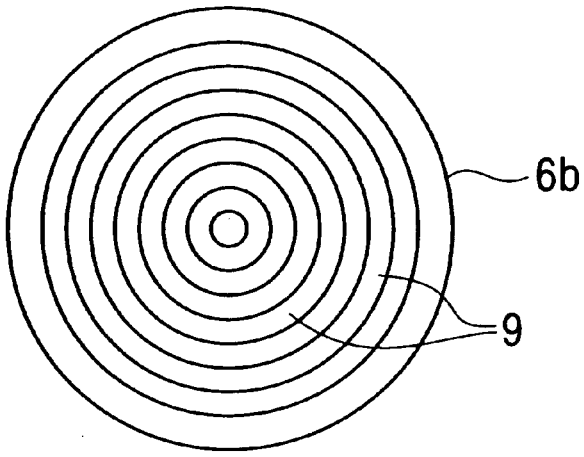
FIG. 11 is a right side view of FIG. 10.
Figure 12:
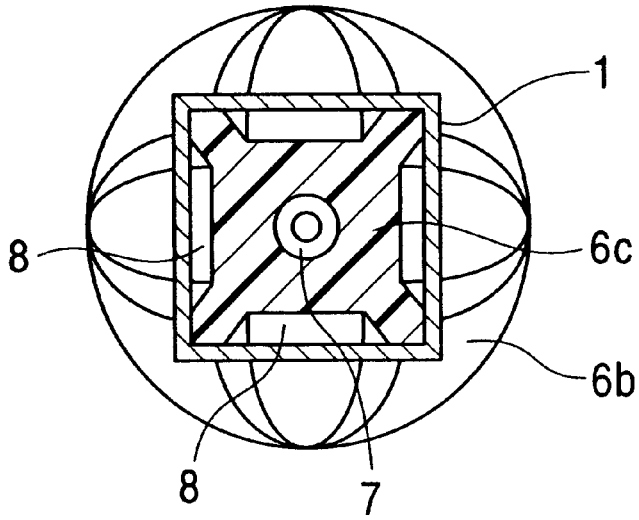
FIG. 12 is a sectional view taken along the line XII—XII of FIG. 10.
Figure 13:
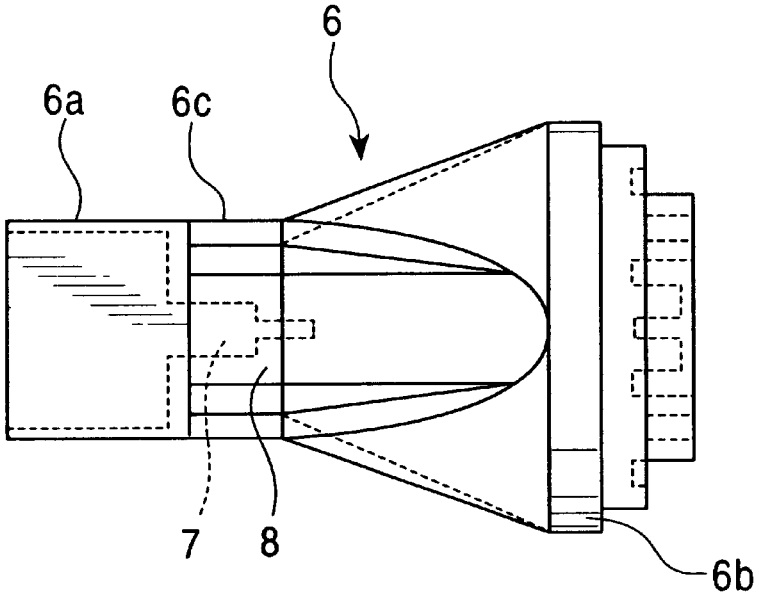
FIG. 13 is a front view of a dielectric feeder within a primary radiator.
Figure 14:
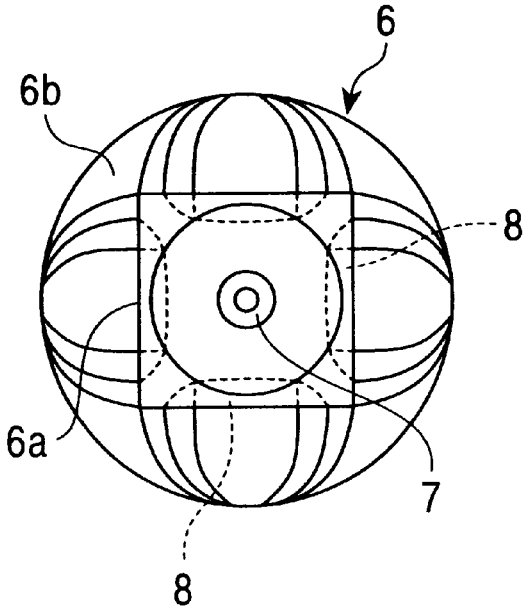
FIG. 14 is a left side view of FIG. 13.

In a fourth embodiment shown in FIG. 9, the waveguide 1 has a substantially straight interior in which the cross-sectional size of the opening of each section are substantially equal. A step like difference 2*d* is formed in a boundary portion between the holding section 2*a* and the radiation section 2*b* of the dielectric feeder 2. An annular gap 5 is formed by this step like difference 2*d* between the inner wall of the opening of the waveguide 1 and the outer surface of the dielectric feeder 2.

In this embodiment the waveguide 1 has a substantially straight shape. When the waveguide 1 is, for example, molded by an aluminum die casting, etc., the die construction can be simplified. However, the waveguide 1 can be manufactured by many other ways such as by pressing a metal sheet. Accordingly, manufacturing costs can be reduced when making this embodiment.

As shown in FIGS. 10 to 14, in the primary radiator of a fifth embodiment, the waveguide 1 has a substantially straight shape having a rectangular cross section. A dielectric feeder 6 comprises a holding section 6*a* having a hollow rectangular interior, an impedance conversion section 6*c* which is continuous with the holding section 6*a*, and a horn-shaped radiation section 6*b* which is continuous with the impedance conversion section 6*c*.

The outer dimension of the holding section 6*a* is nearly the same size as the opening of the waveguide 1 in this embodiment. Holding section 6*a* is inserted from the open end of the waveguide 1 and is fixed to an interior of the waveguide 1 by any suitable means such as press fitting or bonding. Inside the impedance conversion section 6*c*, a stepped hole 7 is formed by two cylindrical holes, one small hole and one large hole that together extend toward the radiation section 6*b*. Preferably, the depth of the two cylindrical holes are about ¼ of the wavelength $\lambda_\epsilon$ of the radio waves that propagate inside the dielectric feeder 6.

Recessed portions 8 are formed on four mutually perpendicular outer surfaces of the impedance conversion section 6*c* in this embodiment. Preferably, each recessed portion 8 extends along a peripheral surface, which extends into the horn shape of the radiation section 6*b*. The impedance conversion section 6*c* is inserted from the open end of the waveguide 1 and is held by the inner wall of the waveguide 1 at four projecting corners positioned between recessed portions 8. As a result, in the portion from the holding section 6*a* to the open end of the waveguide 1, each recessed portion 8 faces the inner wall surface of the waveguide 1 with a predetermined spacing (see FIG. 12). In alternative embodiments, the spacing may be substantially equal. The depth and the width of the gap defined by each recessed portion 8 are positioned a manner that is substantially similar to the gap 5 described in the third and fourth embodiments. Furthermore, the radiation section 6*b* protrudes outward from the open end of the waveguide 1. A plurality of annular grooves 14 is formed concentrically in the end surface of the radiation section 6*b*, and the depth of each annular groove 14 is about ¼ of the wavelength $\lambda_0$ of the radio waves in this embodiment.

Because a gap having a depth of about $\lambda_\epsilon/4$ wavelength is provided by each recessed portion 8 positioned inside the opening of the waveguide 1 in the fifth embodiment, the phases of the surface current that flows on the outer surface of the impedance conversion section 6*c* toward the holding section 6*a* of the dielectric feeder 6 and a surface current which flows on the inner surface of the waveguide 1 from the holding section 6*a* toward the open end of the waveguide 1 are substantially out of phase and cancel each other. Furthermore, since a plurality of recessed portions 8 is formed on the outer surface of the dielectric feeder 6 with the projecting portions remaining on the outer surface of the dielectric feeder 6, and these projecting portions are held to the inner wall of the waveguide 1, the holding strength of the dielectric feeder 6 can be increased. In addition, since the stepped hole 7 that functions as the impedance conversion section 6*c* is within the dielectric feeder 6, the overall length of the dielectric feeder 6 can be shortened, and the size of the primary radiator can be reduced.

However, the primary radiator is not limited to the above-described embodiments and many alternatives are possible. For example, the cross sectional shape of the waveguide 1 and the dielectric feeder 6 may be circular in addition to many other shapes.

In the primary radiator in which the radiation section of the dielectric feeder protrudes from the opening of the waveguide, and an annular wall is formed to include a bottom and an open end adjacent to the opening of the waveguide, and the depth of this annular wall is about ¼ of the wavelength of the radio waves, the phases of a surface current which flows on the outer surface of the opening of the waveguide and a surface current which flows on the inner surface of the annular wall are substantially out of phase and cancel. Accordingly, the side lobes are greatly reduced, and the gain of the main lobe is increased improving satellite reception.

In the primary radiator in which the radiation section of the dielectric feeder protrudes from the opening of the waveguide, and a gap having a depth of about ¼ of the wavelength of the radio waves is provided between the inner surface of the opening of the waveguide and the outer surface of the dielectric feeder, the phases of a surface current which flows on the outer surface of the dielectric feeder and a surface current which flows on the inner surface of the waveguide are substantially out of phase and cancel each other in the gap. Accordingly, the side lobes of a received radio signal are greatly reduced, and the gain of the main lobe is increased improving reception of satellite signals.

Given that the openings and gaps are formed by structures that substantially cancel current that flow on an exterior or interior surface of the dielectric feeder 2, the invention encompasses any structure that achieves that function. Accordingly, any structure that creates a current that is about 180 degrees or a multiple of about 180 degrees (e.g. about 180*n, where "n" is an integer) out of phase with the current that flows on the exterior or interior surface of the dielectric feeder may be used in alternative embodiments.

Many other embodiments of the invention may be constructed without departing from the spirit and scope of the invention. It should be understood that the present invention is not limited to the embodiments described in this specification. To the contrary, the invention covers various modifications and equivalent arrangements included within the spirit and scope of the invention as claimed.

What is claimed is:

1. A primary radiator comprising:

a waveguide having a first opening at an end; and a dielectric feeder held within the waveguide in which a radiation section of the dielectric feeder protrudes from the first opening, wherein an annular wall surrounds a second opening and couples the waveguide through a bottom wall, wherein the second opening is positioned adjacent to the first opening of the waveguide, and the depth of the annular wall is about ¼ of a wavelength and the width of the second opening is about ⅙ to 1/10 of the wavelength of a received radio wave.

2. The primary radiator according to claim 1, wherein a plurality of annular walls surround the first opening.

3. A primary radiator comprising:

a waveguide having an opening at an end; and a dielectric feeder held within the waveguide and comprising a radiation section protruding from the opening, wherein a gap extends from the opening end into the waveguide, the gap having a depth of about ¼ of the wavelength of a plurality of radio waves adjacent to the opening is positioned between an inner wall surface of the waveguide and an outer surface of the dielectric feeder.

4. The primary radiator according to claim 3, wherein the width of the gap is about ⅙ to 1/10 of a diameter of the opening.

5. The primary radiator according to claim 4, wherein the gap surrounds the entire periphery of the inner wall surface of the opening.

6. The primary radiator according to claim 4, wherein a plurality of recessed sections is formed on the outer surface of the dielectric feeder, and the gap is formed in part by at least the recessed sections.

7. The primary radiator according to claim 3, wherein the gap surrounds the entire periphery of the inner wall surface of the opening.

8. The primary radiator according to claim 3, wherein a plurality of recessed sections is formed on the outer surface of the dielectric feeder, and the gap is formed in part by the recessed sections.

9. A primary radiator comprising:

a waveguide having an opening at an end;

a dielectric feeder positioned within the waveguide and comprising an impedance conversion section and a radiation section, the radiation section protruding from the opening; and a gap enclosed by a surface of the dielectric feeder extending from an inner portion of the waveguide through the opening and through a portion of the radiation section, wherein a length of an inner surface of the waveguide in the gap is about ¼ of the wavelength of a plurality of radio waves.

10. The primary radiator according to claim 9, wherein the width of the gap is about ⅙ to 1/10 of a diameter of the opening.

11. The primary radiator according to claim 10, wherein a plurality of recessed sections is formed on the outer surface of the dielectric feeder, and the gap is formed in part by at least the recessed sections.

12. The primary radiator according to claim 9, wherein a plurality of recessed sections is formed on the outer surface of the dielectric feeder, and the gap is formed in part by the recessed sections.

* * * * *